US008313793B2

(12) United States Patent
Nizienko

(10) Patent No.: US 8,313,793 B2
(45) Date of Patent: Nov. 20, 2012

(54) METHOD FOR PRODUCING AND VISUALIZING AN OPTICALLY HIDDEN MARK

(75) Inventor: Yuri Konstantinovich Nizienko, Moskovskaya Oblast (RU)

(73) Assignee: Valinmark Inc., Toronto, Ontario (CA)

( * ) Notice: Subject to any disclaimer, the term of this patent is extended or adjusted under 35 U.S.C. 154(b) by 676 days.

(21) Appl. No.: 12/375,906

(22) PCT Filed: Aug. 4, 2006

(86) PCT No.: PCT/RU2006/000412

§ 371 (c)(1),
(2), (4) Date: Nov. 6, 2009

(87) PCT Pub. No.: WO2008/020781

PCT Pub. Date: Feb. 21, 2008

(65) Prior Publication Data

US 2010/0054528 A1 Mar. 4, 2010

(51) Int. Cl.
*B05D 3/12* (2006.01)
*B05D 5/06* (2006.01)

(52) U.S. Cl. ..... 427/7; 427/526; 427/569; 427/256; 427/355

(58) Field of Classification Search ..... 427/7, 526, 427/569, 256, 355
See application file for complete search history.

(56) References Cited

U.S. PATENT DOCUMENTS 4,467,172 A 8/1984 Ehrenwald
4,606,927 A * 8/1986 Jones ..... 427/7
4,912,290 A 3/1990 Tanaka et al.
6,281,468 B1 8/2001 Souel
6,905,725 B2 6/2005 Dykhne et al.

FOREIGN PATENT DOCUMENTS

| | | |
|---|---|---|
| EP | 31633 | 8/1981 |
| EP | 1391841 | 2/2004 |
| RU | 2037985 | 6/1995 |
| RU | 2073270 | 2/1997 |
| RU | 48399 | 10/2005 |
| WO | WO 99/34315 | 7/1999 |

(Continued)

OTHER PUBLICATIONS

International Search Report from counterpart application No. PCT/RU 2006/000412; Report dated Apr. 19, 2007.

(Continued)

*Primary Examiner* — Kirsten Jolley
(74) *Attorney, Agent, or Firm* — Miller, Matthias & Hull LLP

(57) ABSTRACT

The invention relates to read/write methods for information hidden from visual perception and can be used to visualize hidden images of identification of an object, which provide protection against unauthorized reproduction. The surface of the object is first polished. An optically invisible marking image is formed on the polished surface by modifying at least one area of the surface, which changes the surface energy of modified sites. Said marking image is visualized by establishing a meta-stable environment in the vicinity of the aforementioned surface of the object. The marking image is produced in the form of distinguished structures formed by stable phase particles of the meta-stable environment at the sites of the object surface having different surface energy. Prior to performing a visualization process of the optically invisible marking image, the surface containing the modified areas is electrically-charged and cleaned by friction.

4 Claims, 1 Drawing Sheet

FOREIGN PATENT DOCUMENTS

WO WO 02/089041 11/2002

OTHER PUBLICATIONS

International Preliminary Report on patentability in relation to PCT/RU2006/00412, issued on Feb. 10, 2009.

Translation of International Preliminary Report on patentability in relation to PCT/RU2006/000412, issued on Apr. 7, 2009.

Translation of the Written Opinion of the International Searching Authority, mailed on Apr. 19, 2007.

* cited by examiner

METHOD FOR PRODUCING AND VISUALIZING AN OPTICALLY HIDDEN MARK

CROSS-REFERENCE TO RELATED APPLICATIONS

This application is a U.S. national stage filing of International Patent Application No. PCT/RU2006/000412 filed on Aug. 4, 2006.

FIELD OF THE DISCLOSURE

The invention relates to readout devices for information hidden from visual perception and can be mainly used to visualize hidden images of identification (marks) of an object, which provide protection against unauthorized reproduction (forgery), as well as for research purposes for the visualization of optically invisible structures in the surface layer of an object by variation in surface energy values.

BACKGROUND OF THE DISCLOSURE

From the prior art, a method is known for creation and visualization of optically invisible marks, according to which the surface area of the protected object (in particular, jewelry in the form of a diamond), by means of a laser beam is formed an image hidden to perception by the naked eye (the protective label), the subsequent visualization of which can be carried out by the use of appropriate optical means (U.S. Pat. No. 4,467,172).

The disadvantages of the known prior art method of visualizing hidden images include its limited field of use, For example, in marking jewelry, particularly diamonds, the geometric parameters of microstructures of the protective labels, subject to visualization by optical means, are so large that they are regarded to be a defect in the product, thereby dramatically reducing its aesthetic properties and value.

There is also a way of creating and visualizing an optically invisible mark, according to which an optically invisible marking image is created on the surface of the object by modifying at least one area of the surface, followed by visualization of the marking image microstructure by etching and subsequent viewing of the image using the strong optical or electron microscope (RU, No. 2073270, C1).

The disadvantages of this known prior art method of creating and visualizing an optically invisible mark, as in the previous case, include the limited field of application because of its applicability only to the special polymer materials in the form of films, as well as the inability to visualize the latent marking images without the use of powerful microscopes.

In addition, the known method does not save the label optically invisible after the first visualization (i.e. visualization by etching).

The closest to the claimed invention is a method of creation and visualization of an optically invisible mark, according to which the surface of the object is first polished. On the polished surface, an optically invisible marking image is formed by modifying at least one area of the surface. As a result of surface modification, the surface energy of modified sites changes. Said marking image is then visualized by means of establishing a meta-stable environment in the vicinity of the aforementioned surface of the object. By means of said environment, the marking image is produced in the form of distinguished structures formed by stable phase particles of the meta-stable environment at the sites of the object surface having different surface energy. (WO 02/089041, C1, EP 1391841).

The disadvantages of the known method include a relatively low contrast of the visually perceived marking image because of the small difference in the surface energy of modified and un-modified surface areas, and hence the image quality being highly dependent on the investigated surface contamination.

Furthermore, during repeat visualization of tags, the marking image may be overlapped by the image of a structure formed by the merger of several centers of condensation and the emergence of new centers during evaporation of the condensate from the previous visualization (FIG. 1). That is, the relatively uniform layer of surface contamination micro-particles (which are always present in the real world visualization) is modified in the event of condensation of droplets on the surface and evaporation of condensate with the formation of randomly distributed micro-particle islets on the examined surface. In the subsequent visualization, these micro-particle islets may become additional functional centers of condensation, distorting the marking image.

SUMMARY OF THE DISCLOSURE

The basis of the disclosed invention is the task of creating a durable, optically invisible mark (i.e., invisible with the help of any optical microscope), on surface of the object, with high quality visualized image, in particular, high contrast and spatial resolution in the real world environment, with any number of consecutive visualization cycles by means of increasing the density of condensation centers, which form a mark during its visualization, and by reducing the impact of surface contamination on the contrast of the viewed image.

The stated task is solved by utilizing a method of creation and visualization of optically invisible mark, according to which the surface of the object is first polished and an optically invisible marking image is formed on the polished surface by modifying at least one area of the surface; as a result of said surface modification, the surface energy of modified sites changes and said marking image is then visualized by means of establishing a meta-stable environment in the vicinity of the aforementioned surface of the object; by means of said environment, the marking image is produced in the form of distinguished structures formed by stable phase particles of the meta-stable environment at the sites of the object surface having different surface energy, whereby, according to the invention, prior to performing each visualization process of the optically invisible marking image, the surface in question, containing the modified areas, is electrically charged and cleaned by friction.

BRIEF DESCRIPTION OF THE DRAWINGS

The invention is illustrated by the following graphics.

DETAILED DESCRIPTION OF THE DISCLOSURE

Figure 1:
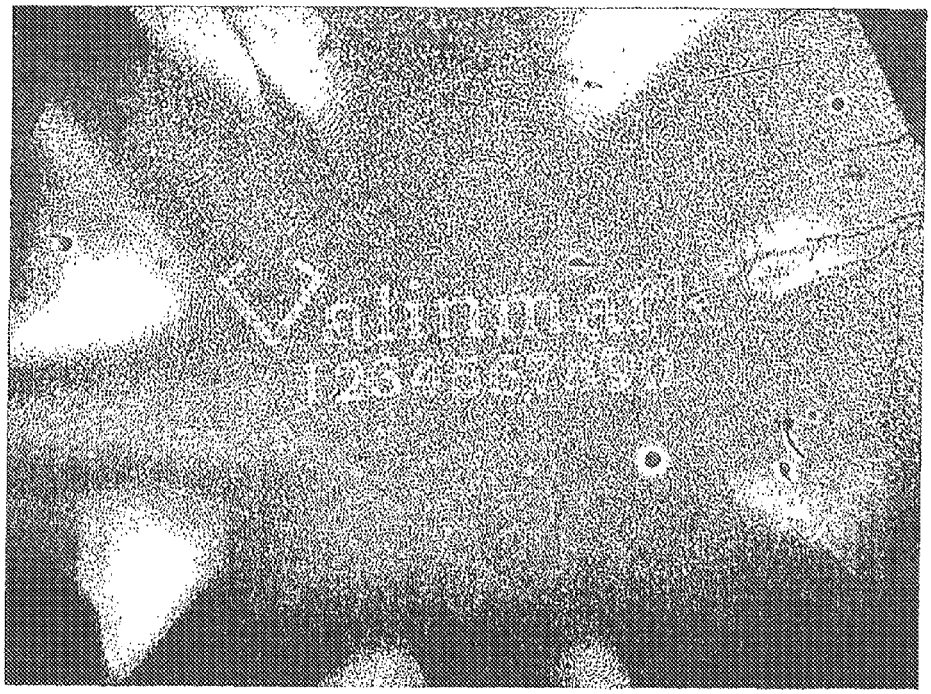
FIG. 1—the surface of the object with an optically invisible marking image upon performing the visualization process according to the prototype method.

The claimed method is embodied as follows.

The surface of the object is first polished. An optically invisible marking image is formed on the polished surface by modifying at least one area of the surface. As a result of said surface modification, i.e. by changing the composition and/or the structure of the near-surface atomic layers of the object in question, changes the surface energy of modified sites. Concurrently with the changes in surface energy of the modified sites also change the adhesion properties of these sites, being, just as the surface energy, a function of the degree of disbalance of surface charges within the surface in question. Said marking image is then visualized by means of establishing a meta-stable environment in the vicinity of the aforementioned surface of the object. By means of said environment, the marking image is produced in the form of distinguished structures formed by stable phase particles of the meta-stable environment at the sites of the object surface having different surface energy.

The main characteristic feature of the claimed method is that prior to performing a visualization process of the optically invisible marking image, the surface in question, containing the modified areas, is electrically charged and cleaned by friction.

As a result electrically charging the investigated surface, the excess static electricity charge is distributed on this surface in line with the level of local disbalance of surface charges formed in the modification process. This results in enhanced heterogeneity of distribution and increased density of surface charges, which serve as condensation initiators in the process of visualizing the mark. This decreases the dependence of the visualized image contrast on the contamination level of the viewed surface.

Electrical charging through friction results in simultaneous cleaning of the surface, because, as a result of treatment by friction, the microparticle islets of impurities formed after evaporation of condensate from the previous visualization process, and being additional functional centers of condensation distorting the marking image, are removed.

Thus, when performing visualization of the surface with modified sites after electrically charging and cleaning it by friction increases the contrast of the image while reducing the dependence of image quality on the contamination level of the investigated surface.

Supercooled water vapor from ambient air, which is formed when the air contacts the cooled object in question, is typically used as the metastable environment.

Images of structures, formed by stable phase particles of the metastable environment, develop in the form of water droplets on the surface of the object.

The dynamics of stable phase formation on the surface of the object from the metastable environment depends on the free surface energy or the magnitude of adhesion. Within the surface sites with different surface energy, the meta-stable environment converts into stable phase in different ways.

The mark is durable because surface modification of an object, causing changes in its surface energy, obtained, for example, by using spatially modulated metals ion beams (e.g. hafnium, chromium), leads to a stable (including at ambient conditions) change in the composition and structure of the surface with modified surface energy.

An example of a specific embodiment of the claimed method.

Figure 2:
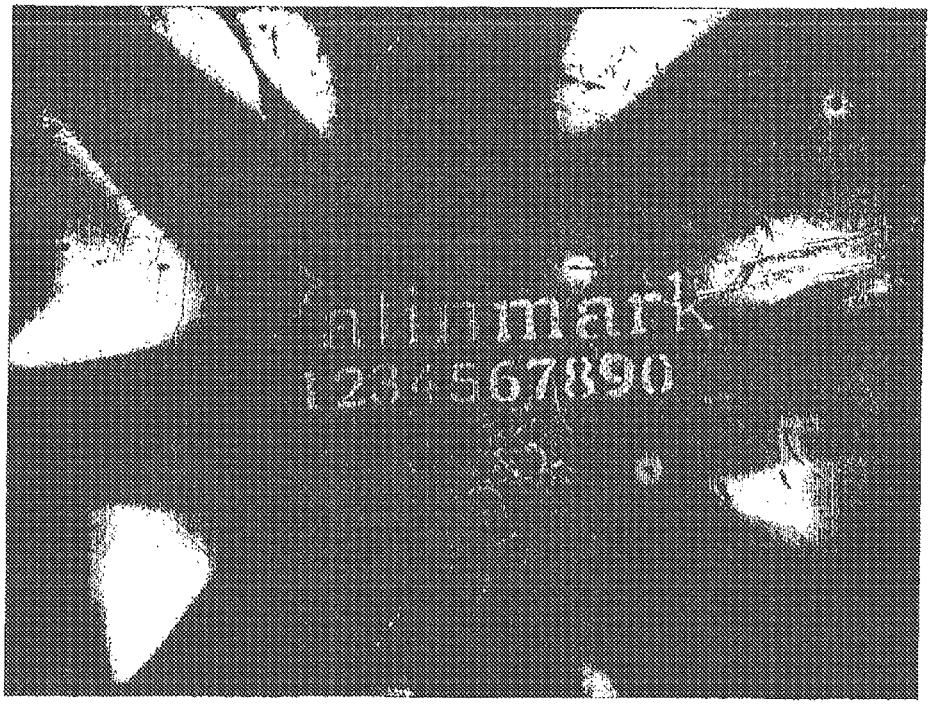
FIG. 2—the surface of the object with an optically invisible marking image upon performing the visualization process according to the claimed method.

A hidden (optically invisible) marking image in the form of inscriptions and figures was formed on the polished surface of diamond sample by modifying the surface of the specimen using the ion beam (hafnium ions), passed through a stencil mask. This is followed by electrical charging and cleaning by friction of the surface in question containing the modified sites. An optical element wiping cloth, enclosed in a dielectric frame, was used for electrical charging and cleaning of the surface. Note that various solvents can be used for cleaning of heavily contaminated surfaces; however, immediately before the visualization of the image, the electrical charging and cleaning of the sample surface is carried out without using any liquids (by dry friction). For visualization of optically invisible image, the sample was put in contact with the cold surface of thermoelectric Peltier element for a few seconds. As a result, water vapor from ambient air condensed on the cooled surface. The optically invisible marking image is visualized in the form of droplets of water condensate distributed in a specific manner on the surface of the object, as shown in FIG. 2 of the graphic materials, showing the visually perceived marking image formed from droplets of water condensate at a 30× magnification.

Tests carried out for one year on the original mark (shown in FIG. 2), revealed no decrease in the image contrast after multiple visualization during the test period. Multiple visualization of the marking image using metastable medium does not turn the optically invisible marking image in a permanently visible one, as is the case, for example, in the prototype method after the optically invisible mark in the polymer film is visualized by the use of alkali etching.

Industrial Applicability

Thus, the claimed invention may find wide application in various fields of science and technology for the reading/writing information hidden from visual perception. In particular, it can be used for multiple visualization of hidden images (marks) that identify an object and provide protection against unauthorized reproduction (forgery), as well as for scientific research purposes for visualization of optically invisible structures that vary only in their surface energy levels.

The invention claimed is:

1. A method of creation and visualization of optically invisible marks, whereby the surface of the object is first polished and an optically invisible marking image is formed on the polished surface by modifying at least one area of the surface; as a result of said surface modification, the surface energy of modified sites changes and said marking image is then visualized by means of establishing a meta-stable environment in the vicinity of the aforementioned surface of the object; by means of said environment, the marking image is produced in the form of distinguished structures formed by stable phase particles of the meta-stable environment at the sites of the object surface having different surface energy, characterized by that, prior to performing the visualization process of the optically invisible marking image, the surface in question containing the modified areas, is electrically charged and cleaned by friction.

2. The method of claim 1, wherein the object is a jewel.

3. The method of claim 1, wherein the object is a diamond.

4. The method of claim 1, wherein the friction is dry friction.

* * * * *